United States Patent [19]

Wooten

[11] Patent Number: 4,635,397

[45] Date of Patent: Jan. 13, 1987

[54] COMBINATION LOCK AND CONCEALED LATCH MECHANISM FOR A DOOR PANEL

[75] Inventor: Ronald E. Wooten, Moreno Valley, Calif.

[73] Assignee: Excel Industries, Inc., Elkhart, Ind.

[21] Appl. No.: 796,927

[22] Filed: Nov. 12, 1985

[51] Int. Cl.[4] ..... E05B 65/06

[52] U.S. Cl. ..... 49/394; 292/153; 292/175; 292/DIG. 63

[58] Field of Search ..... 49/394; 292/153, 154, 292/163, 175; 70/467, 470, 150

[56] References Cited

U.S. PATENT DOCUMENTS

| | | | |
|---|---|---|---|
| 2,900,204 | 8/1959 | Pelcin | 292/153 X |
| 3,473,834 | 10/1969 | Lehmann et al. | 292/175 |
| 3,909,051 | 9/1975 | Nakai | 292/153 X |

*Primary Examiner*—Kenneth Downey

*Attorney, Agent, or Firm*—James D. Hall

[57] ABSTRACT

A combination lock and latch mechanism for an access panel. The latch mechanism includes a biased latch part which is located behind the panel and accessible through the panel.

3 Claims, 6 Drawing Figures

COMBINATION LOCK AND CONCEALED LATCH MECHANISM FOR A DOOR PANEL

SUMMARY OF THE INVENTION

This invention relates to a latch mechanism and associated lock for an access or door panel.

The combination latch and lock of this invention is used in an access member, such as a door, which includes a frame and access panel. The latch includes a latch part and actuator member which is secured within and accessible from outside the panel. The lock includes an arm which is engagable with the latch and which is concealed from outside the panel.

Accordingly, it is an object of the invention to provide an improved combination latch and lock which is for an access member.

Another object of this invention is to provide for an access member latch and lock which is recessed within the access member to provide a flush outer appearance.

Another object of this invention is to provide for an access member which is efficient and economical.

Other objects of this invention will become apparent upon a reading of the following description.

BRIEF DESCRIPTION OF THE DRAWINGS

A preferred embodiment of the invention has been depicted for illustrative purposes wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize the invention.

Figure 1:
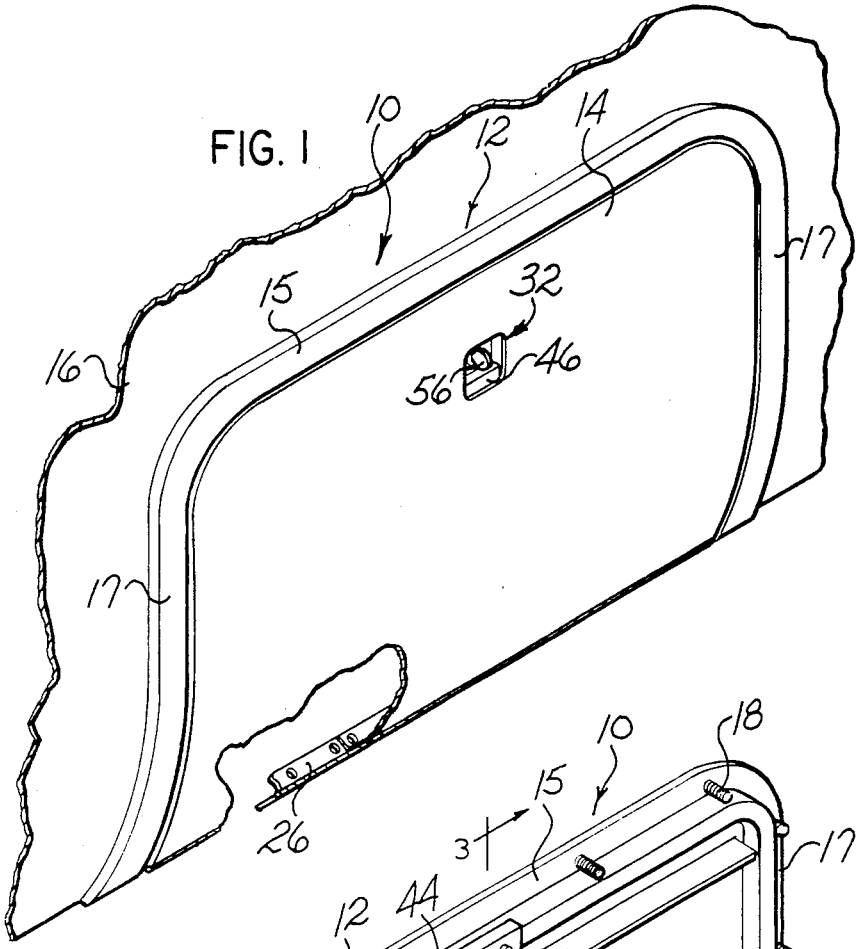
FIG. 1 is a fragmentary perspective view of an access member, in this case, a door, front which employs the lock and latch of this invention.
Figure 2:
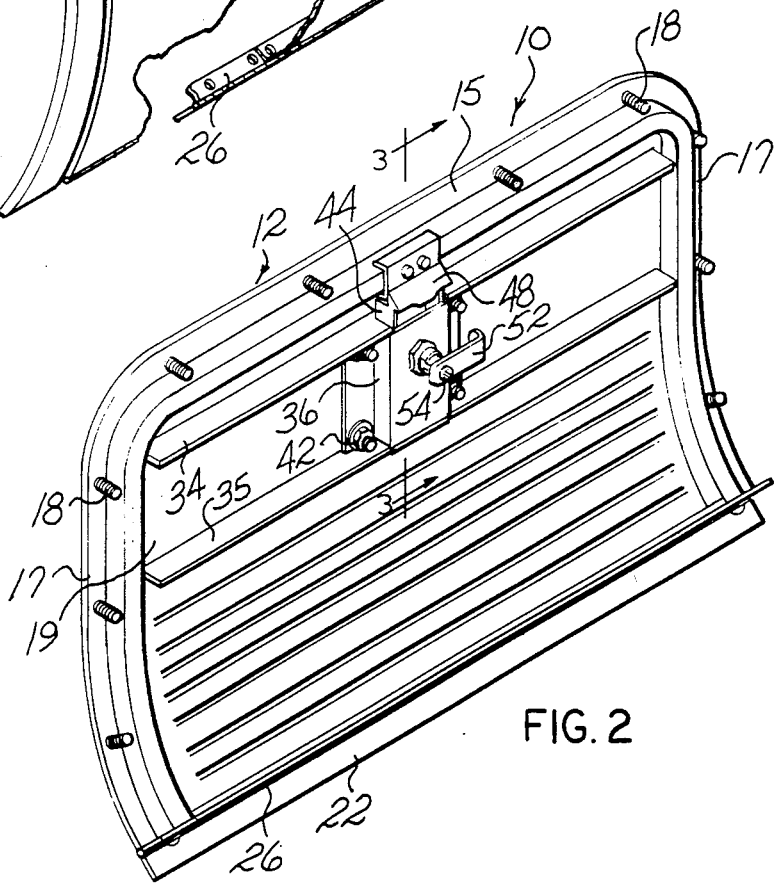
FIG. 2 is a perspective view of the access member of FIG. 1 as seen from the back.
Figure 3:
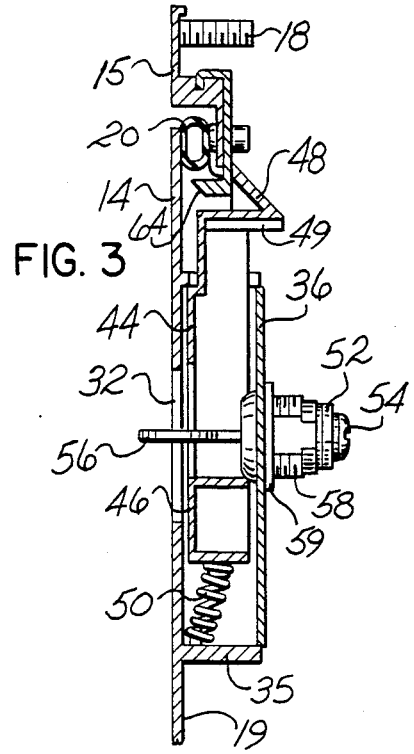
FIG. 3 is a sectional view taken along line 3—3 of FIG. 2.
Figure 4:
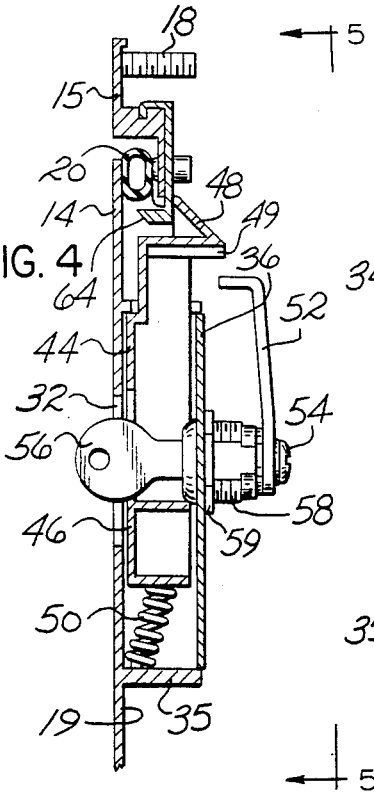
FIG. 4 is a sectional view similar to FIG. 3 with the lock arm in the locked position.

FIGS. 1-2 depict access member 10 which includes frame 12 and access panel or door 14. Frame 12 includes generally S-shaped top member 15 and connected side members 17 and is fastened to a side wall 16 by concealed fasteners 18 (see FIG. 2). A flexible seal 20 is fixed to frame 12 as shown in FIGS. 3-4 and seals the access panel 14 when closed. Frame 12 includes a bottom flange 22 to which panel 14 is connected by a hinge 26.

Figure 6:
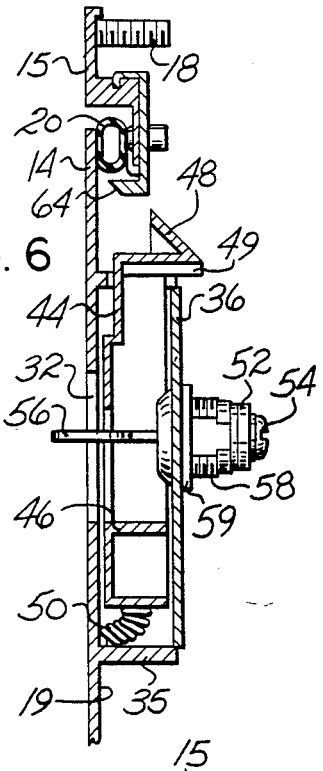
FIG. 6 is a view similar to FIG. 3 with the latch part in the unlatched position.

Hinge 26 allows panel 14 to be pivoted between a closed position (FIG. 1) and an open position (not shown). Panel 14 spans the internal periphery of frame 12 and includes an opening 32 which extends completely through the panel. A plurality of support ribs 34,35 extend from panel interior face 19 on opposite sides of opening 32. A channelled bracket lock 36 is secured to panel face 19 by fasteners 42. Lock bracket 36 extends spacedly over panel opening 32. A latch 44 which includes an actuator portion 46 and an angled latch part 48 is positioned between lock bracket 36 and panel 14 behind panel opening 32 for slidable movement between a latched position (FIGS. 3-4) and an unlatched position (FIG. 6). A spring 50 which abuts latch part actuator portion 46 and panel support rib 35 serves to normally urge latch 44 into its latched position with latch part 48 overlying frame member 15. A lock arm 52 is rotatably connected by a screw 54 to a lock cylinder 58. Cylinder 58 in turn is connected by nut 59 to lock bracket 36. Upon insertion of a key into cylinder 58 and rotation of the key, the lock plug and connected lock arm 52 is turned between the open position of FIGS. 2, 3 and 6 and the locked position of FIGS. 4 and 5.

Access panel 14 is opened and closed as follows. With the panel in the closed position of FIGS. 1-3, latch actuator portion 46 is depressed by one's finger through panel opening 32 until latch part 48 clears frame member 15 as shown in FIG. 6. Access panel 14 may then be pivoted along hinge 26 into an open position. To return panel 14 to its closed position, the panel is pivoted along hinge 26 with angled latch part 48 contacting overlay cam face 64 of frame member 15 to urge the latch part into its unlatched position. Pivotal movement of panel 14 continues until latch part 48 clears frame member 15 and is again in the general position shown in FIG. 6, whereupon spring 50 urges the latch 44 into the locked position of FIGS. 3-4.

Figure 5:
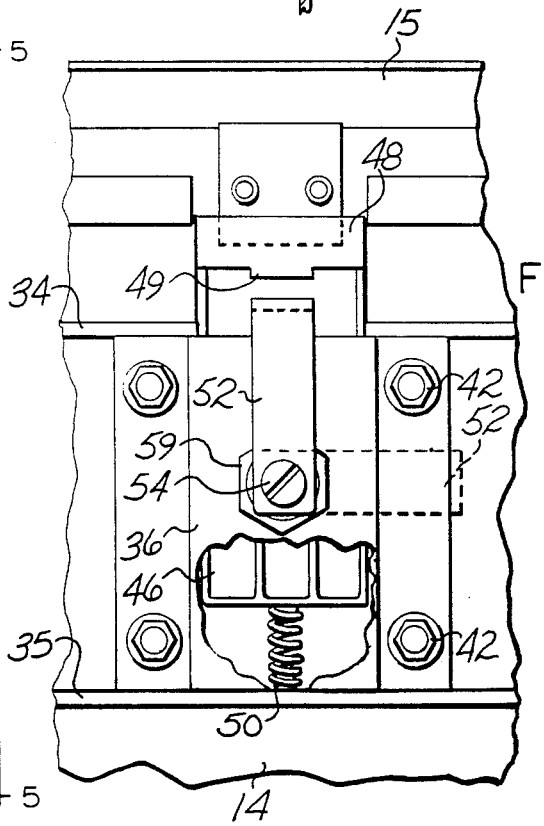
FIG. 5 is a plan view as seen from line 5—5 of FIG. 4.

To lock panel 14, key 56 is turned to rotate lock arm 52 into the locked position shown in FIGS. 4 and 5. In this position, lock arm 52 is positioned immediately beneath center portion 49 of latch part 48, to prevent the latch part from being shifted into its unlatched position. To unlock panel 14, key 56 is turned in the opposite direction to rotate lock arm 52 into the unlocked position shown in broken line form in FIG. 5. A pair of stops (not shown) may be used to limit rotation of lock arm 52 between its solid and broken line positions shown in FIG. 5. As shown in FIG. 1, the only outwardly visible part of the mechanism is latch actuator part 46, which creates an aerodynamic and a pleasing appearance when the panel is in its closed position.

It is understood that the invention is not limited by the above-given details, but may be modified within the scope of the appended claims.

I claim:

1. In combination, a latch and lock for an access member, said access member including an exterior frame defining an opening and an access panel having front and rear sides and hingedly connected to said frame for movement between an open position spaced outwardly of the frame and a closed opening spanning said frame opening, said latch including a latch part positioned behind said panel and shiftable between a latched position engaging said access member frame to secure the panel in its closed position and an unlatched position to permit the panel to shift into its open position, said latch part including hand engagement means shiftable over said panel rear side and accessible only through said panel opening to shift the latch part into its unlatched position, and biasing means for urging said latch part into its latched position.

2. The combination of claim 1 wherein said access member frame includes a cam part, said latch being urged into its unlatched position as said access panel is shifted into its closed position with said latch part engaging said frame cam part.

3. The combination of claim 2 and including an arm pivotable between a locked position adjacent said latch part to prevent the latch part from being shifted into its unlatched position, and an unlocked position spaced from said latch part.

* * * * *